US007621659B1

(12) United States Patent
Chen

(10) Patent No.: US 7,621,659 B1
(45) Date of Patent: Nov. 24, 2009

(54) COLLAPSIBLE LAMPSHADE

(76) Inventor: Ching-Hui Chen, 6F. -1, No. 11, Lane 238, Sihping Rd., Beitun District, Taichung City 406 (TW)

( * ) Notice: Subject to any disclaimer, the term of this patent is extended or adjusted under 35 U.S.C. 154(b) by 0 days.

(21) Appl. No.: 12/199,975

(22) Filed: Aug. 28, 2008

(30) Foreign Application Priority Data

Jun. 4, 2008 (TW) ..... 97209831 U

(51) Int. Cl.
*F21V 17/00* (2006.01)

(52) U.S. Cl. ..... 362/352; 362/434; 362/450

(58) Field of Classification Search ..... 362/352, 362/353, 355, 356, 357, 361, 433, 434, 435, 362/440, 441, 442, 449, 450, 452
See application file for complete search history.

(56) References Cited

U.S. PATENT DOCUMENTS 7,086,760 B2 * 8/2006 Chuang ..... 362/352
2005/0157491 A1 * 7/2005 Li ..... 362/352
2007/0236943 A1 * 10/2007 Lee ..... 362/355
2007/0263392 A1 * 11/2007 Hsieh ..... 362/352

* cited by examiner

*Primary Examiner*—Y My Quach Lee
(74) *Attorney, Agent, or Firm*—Ladas & Parry LLP

(57) ABSTRACT

A collapsible lampshade includes: an upper frame defining an axis, and formed with a plurality of angularly spaced-apart connecting grooves, each of the connecting grooves extending in a radial direction with respect to the axis; a lower frame surrounding the axis; a plurality of support rods each having a first end pivotally connected to the lower frame, and a second end opposite to the first end, the second end being received releasably in and being slidable along a respective one of the connecting grooves; and a foldable cover connected to and extending between the upper frame and the lower frame.

5 Claims, 7 Drawing Sheets

COLLAPSIBLE LAMPSHADE

CROSS-REFERENCE TO RELATED APPLICATION

This application claims priority of Taiwanese application no. 097209831, filed on Jun. 4, 2008.

BACKGROUND OF THE INVENTION

1. Field of the Invention

This invention relates to a collapsible lampshade, more particularly to a collapsible lampshade that is easily collapsed and assembled.

2. Description of the Related Art

FIGS. 1 and 2 illustrate a conventional lampshade that includes an upper frame 2 defining an axis (X) and having an annular member 201 provided with a plurality of angularly spaced-apart insert members 202, a lower frame 1 spaced apart from the upper frame 2, a plurality of angularly spaced-apart support rods 4 each having a first end 401 pivotally connected to the lower frame 1, and a second end 402 opposite to the first end 401, and a cover 3 surrounding the axis (X), and connected to and extending between the lower and upper frames 1, 2. Each of the insert members 202 opens downwardly, and defines a recess 203 that extends along a direction of the axis (X).

When the lampshade is assembled, the second end 402 of each of the support rods 4 is received in a respective one of the recesses 203 of the insert members 202. In this state, the upper frame 2, the lower frame 1, and the support rods 4 cooperate to support the cover 3. When it is desired to disassemble the lampshade, the second end 402 of each of the support rods 4 is removed from the respective one of the recesses 203 so that the upper frame 2, the lower frame 1 and the support rods 4 are stacked on each other, thereby reducing the volume of the lampshade for storage or transport.

However, since the length of the support rods 4 is greater than the distance between the insert members 202 and the lower frame 1, during assembly of the lampshade, the upper frame 2 must be lifted upwardly, and upper end portions of the support rods 4 must be bent so that the second ends 402 of the support rods 4 can be received respectively in the recesses 203 of the insert members 202. Such assembly is difficult to perform since users must guide the second ends 402 of the support rods 4 respectively into the recesses 203 while simultaneously exerting significant forces in pulling upwardly the upper frame 2 and in bending the support rods 4.

SUMMARY OF THE INVENTION

Therefore, an object of the present invention is to provide a collapsible lampshade that can overcome the aforesaid drawback associated with the prior art.

According to the present invention, a collapsible lampshade comprises: an upper frame defining an axis, and formed with a plurality of angularly spaced-apart connecting grooves, each of the connecting grooves extending in a radial direction with respect to the axis; a lower frame surrounding the axis, and spaced apart from the upper frame along a direction of the axis; a plurality of support rods each having a first end pivotally connected to the lower frame, and a second end opposite to the first end, the second end being received releasably in and being slidable along a respective one of the connecting grooves; and a foldable cover surrounding the axis, and connected to and extending between the upper frame and the lower frame.

BRIEF DESCRIPTION OF THE DRAWINGS

Other features and advantages of the present invention will become apparent in the following detailed description of the preferred embodiments of this invention, with reference to the accompanying drawings, in which.

DETAILED DESCRIPTION OF THE PREFERRED EMBODIMENTS

Figure 1:
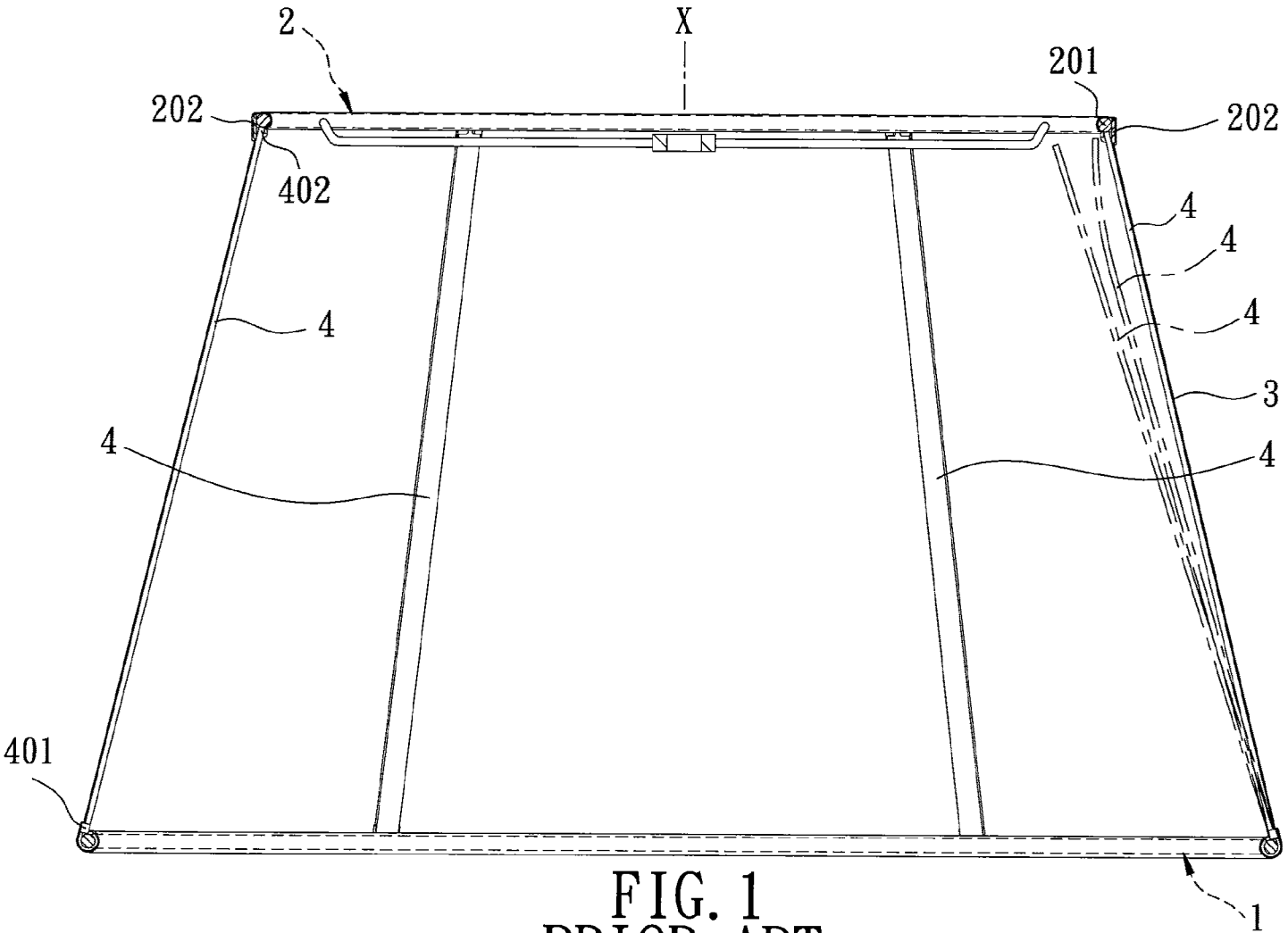
FIG. 1 PRIOR ART
FIG. 1 is a sectional view of a conventional lampshade.
Figure 2:
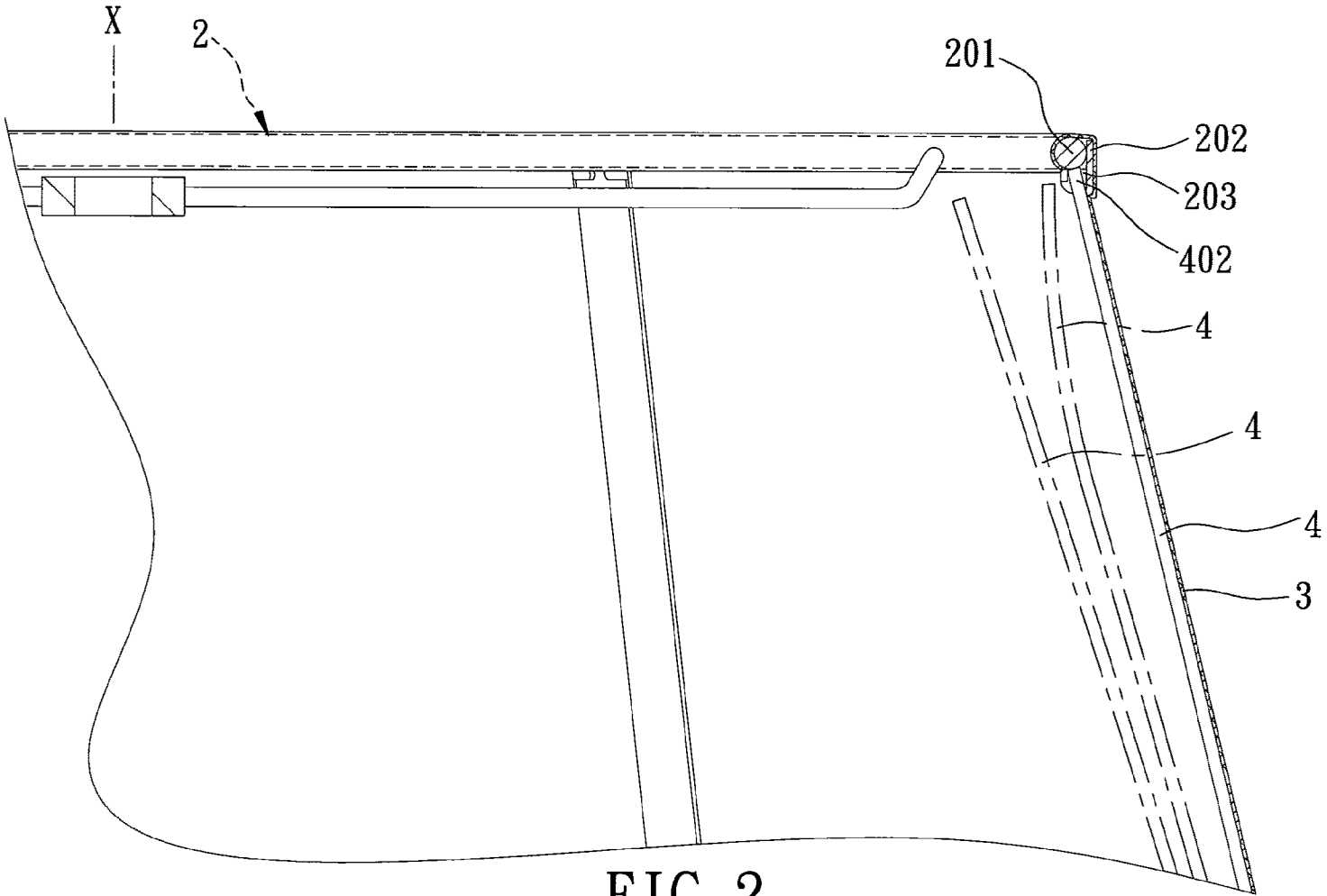
FIG. 2 PRIOR ART
FIG. 2 is an enlarged fragmentary sectional view of the conventional lampshade.
Figure 3:
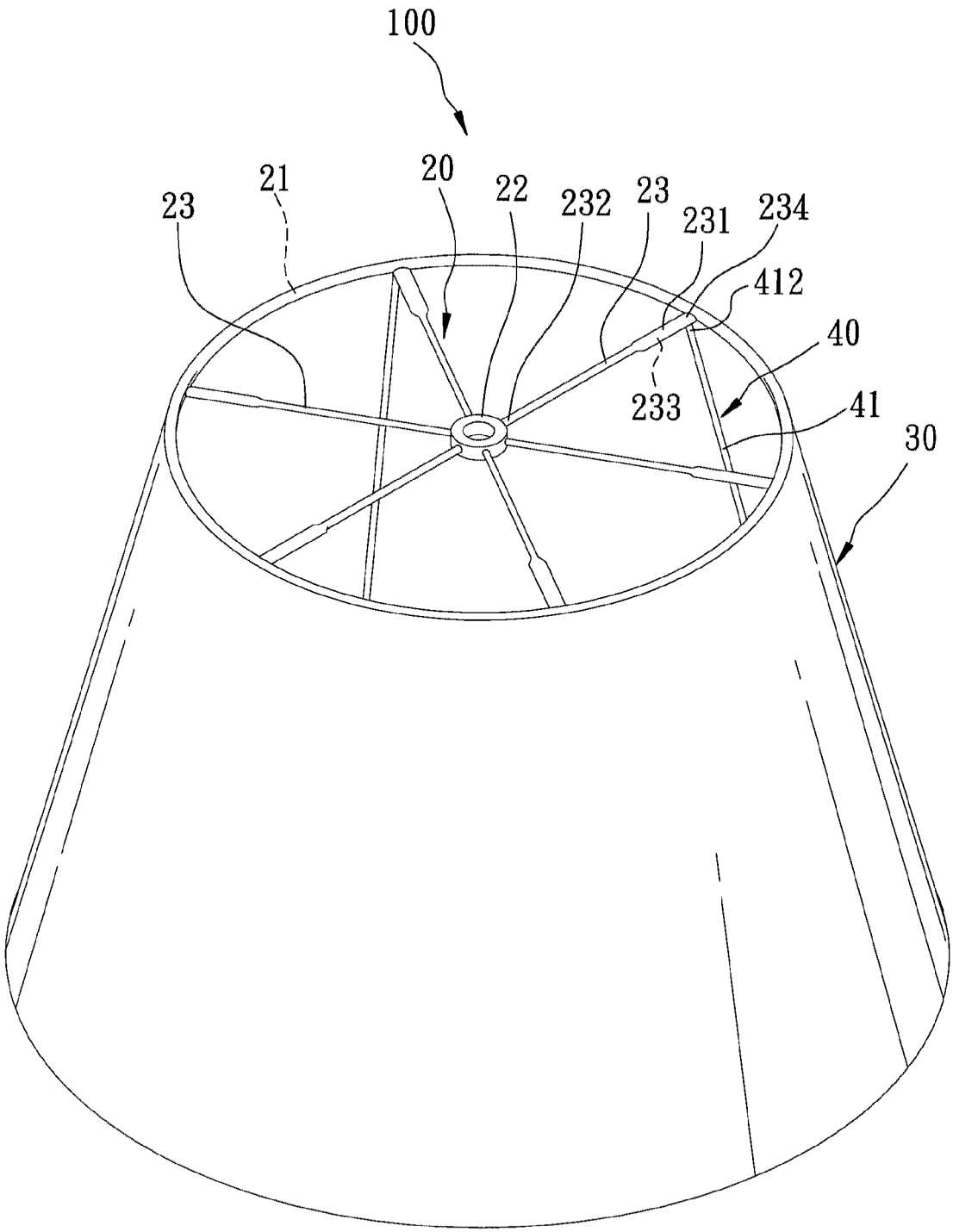
FIG. 3 is a perspective view of the first preferred embodiment of a collapsible lampshade according to this invention.
Figure 4:
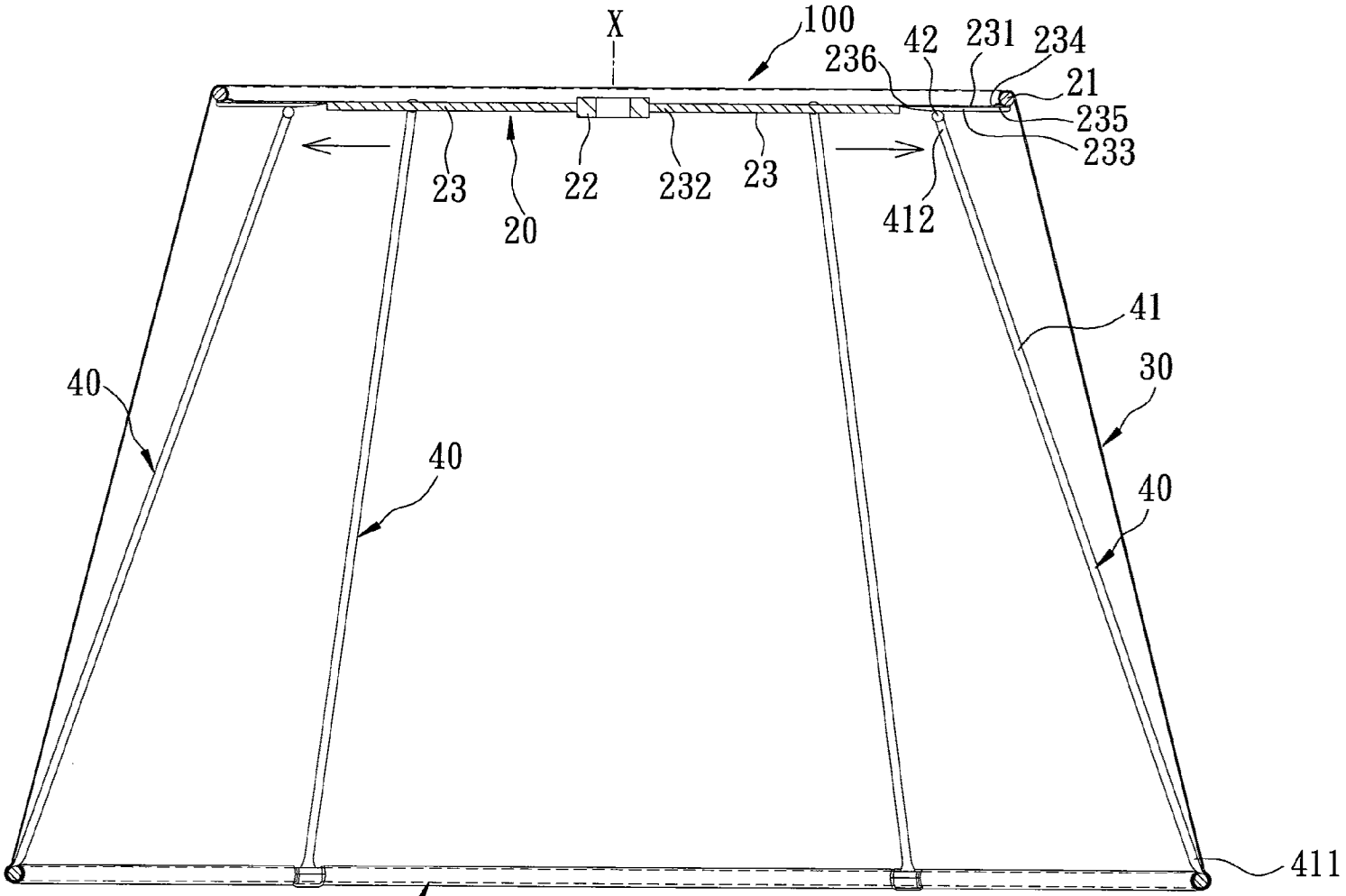
FIG. 4 is a sectional view of the first preferred embodiment.
Figure 5:
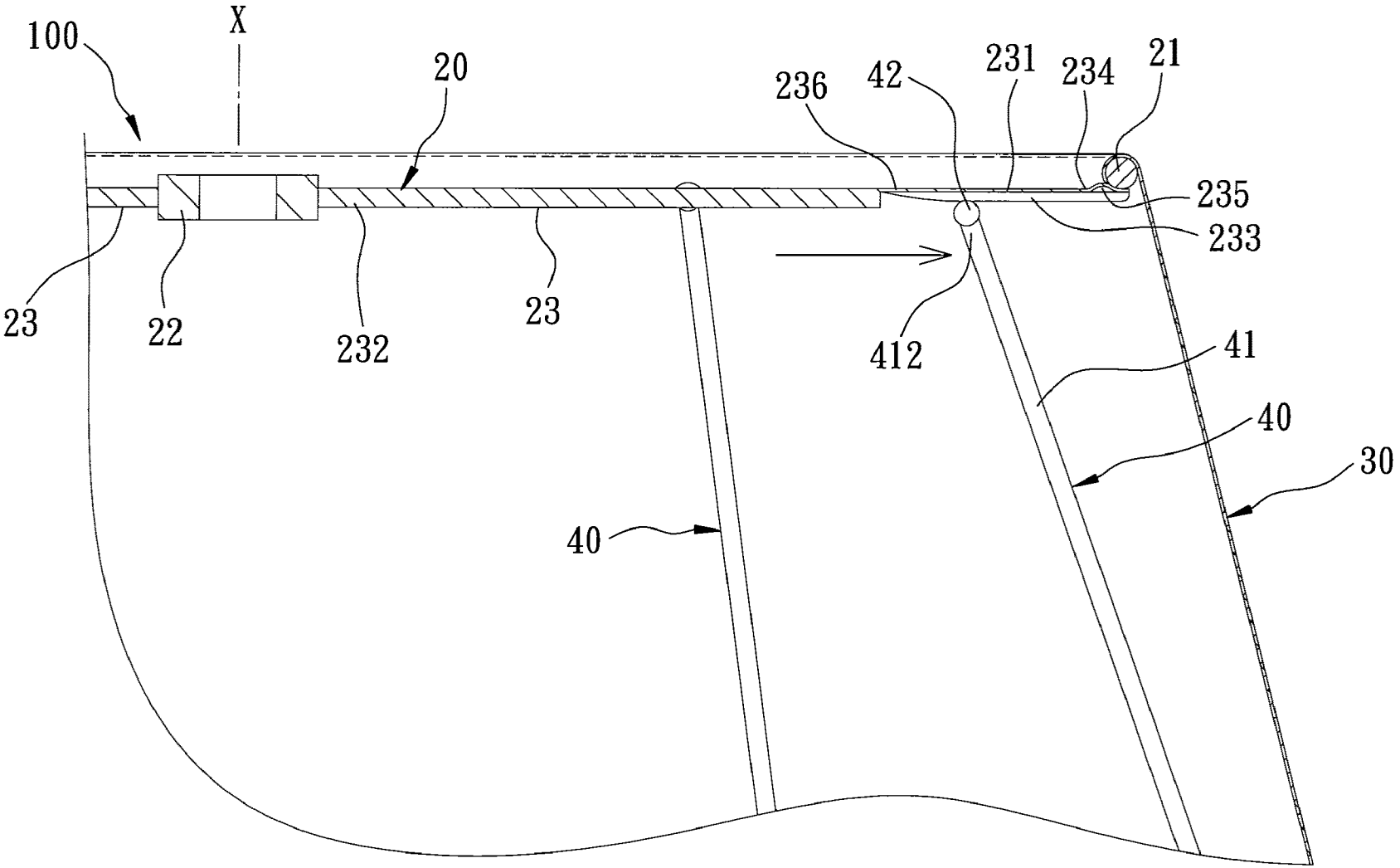
FIG. 5 is an enlarged fragmentary sectional view of the first preferred embodiment.
Figure 6:
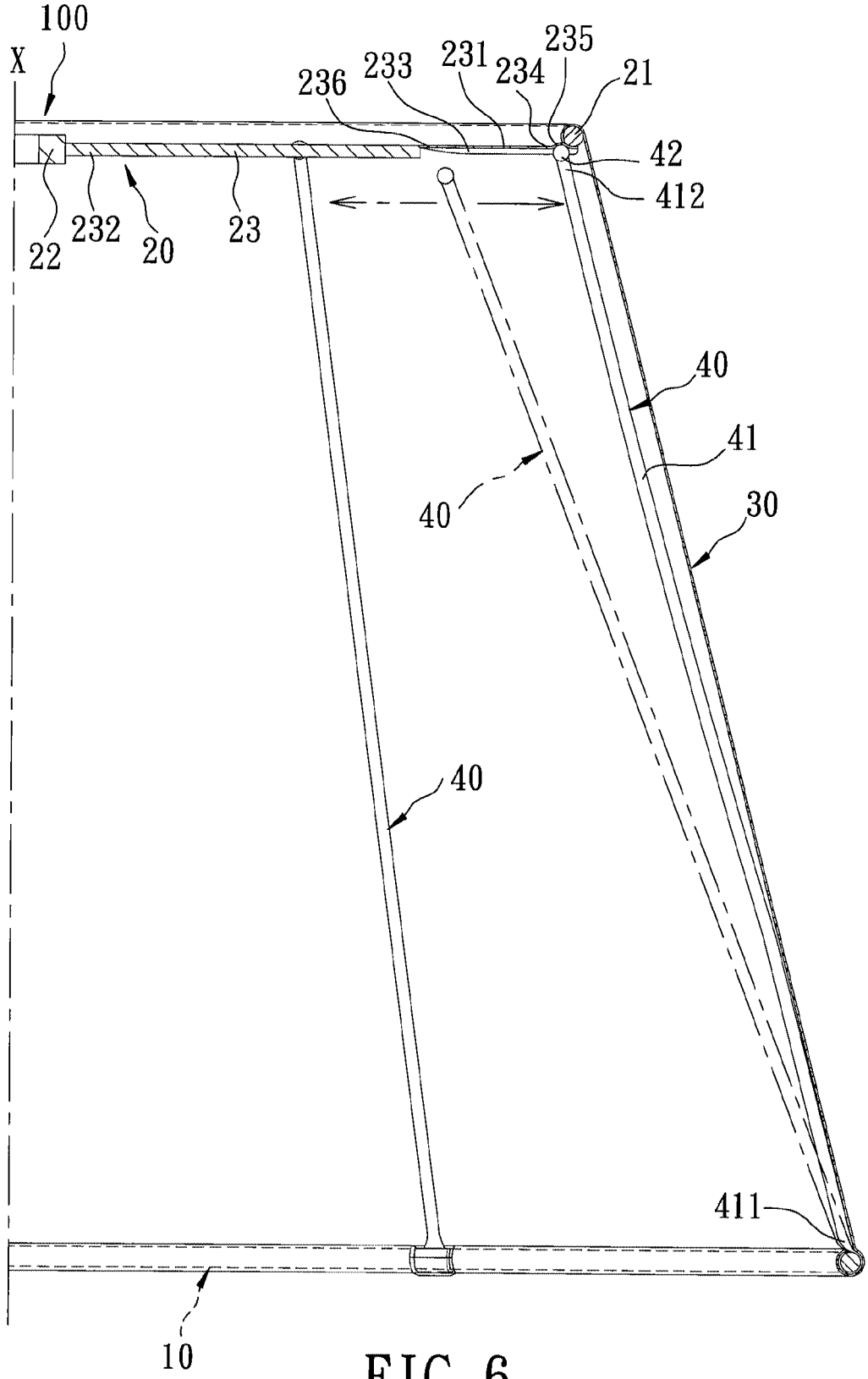
FIG. 6 is another enlarged fragmentary sectional view of the first preferred embodiment.

Before the present invention is described in greater detail with reference to the accompanying preferred embodiments, it should be noted herein that like elements are denoted by the same reference numerals throughout the disclosure.

FIGS. 3 to 6 illustrate the first preferred embodiment of a collapsible lampshade 100 according to this invention.

The collapsible lampshade 100 includes: an upper frame 20 defining an axis (X), and formed with a plurality of angularly spaced-apart connecting grooves 233, each of the connecting grooves 233 extending in a radial direction with respect to the axis (X); a lower frame 10 surrounding the axis (X), and spaced apart from the upper frame 20 along a direction of the axis (X); a plurality of support rods 40 each having a first end 411 pivotally connected to the lower frame 10, and a second end 412 opposite to the first end 411, the second end 412 being received releasably in and being slidable along a respective one of the connecting grooves 233; and a foldable cover 30 surrounding the axis (X), and connected to and extending between the upper frame 20 and the lower frame 10.

Preferably, the cover 30 is made from a foldable fabric material.

In this embodiment, the upper frame 20 includes a plurality of groove-forming walls 231 respectively forming the connecting grooves 233. Each of the groove-forming walls 231 is further formed with a rod-retaining groove 235 that is in spatial communication with a respective one of the connecting grooves 233 and that is indented inwardly a greater amount than the respective one of the connecting grooves 233. The second end 412 of each of the support rods 40 is releasably engaged with the rod-retaining groove 235 of a respective one of the groove-forming walls 231.

In this embodiment, the upper frame 20 further includes an annular outer member 21, an inner member 22 disposed substantially at a center of the outer member 21, and a plurality of angularly spaced-apart connecting ribs 23. Each of the connecting ribs 23 has a first end 232 connected to the inner member 22, and a second end 234 opposite to the first end 232 and connected to the outer member 21. The second end 234 of each of the connecting ribs 23 has a respective one of the groove-forming walls 231.

In this embodiment, each of the groove-forming walls 231 further has an inner end 236.

When the lampshade 100 is assembled, since a distance between the first end 411 of each of the support rods 40 and the rod-retaining groove 235 of a respective one of the groove-forming walls 231 is substantially equal to that between the first and second ends 411, 412 of the support rods 40, the support rods 40 are retained in the rod-retaining grooves 235 so as to be firmly secured between the upper frame 20 and the lower frame 10. On the other hand, since a distance between the first end 411 of each of the support rods 40 and the inner end 236 of a respective one of the groove-forming walls 231 is greater than that between the first and second ends 411, 412 of the support rods 40, the support rods 40 are released from the connecting grooves 233 when the support rods 40 are slid from the rod-retaining grooves 235 to the inner ends 236 of the groove-forming walls 231. With such release of the support rods 40 from the connecting grooves 233, the upper frame 20, the cover 30, and the support rods 40 are collapsible downwardly onto the lower frame 10 so as to reduce the volume of the lampshade 100 to facilitate storage or transport.

In this embodiment, each of the support rods 40 has a rod body 41, and a ball-shaped locking member 42 disposed on an end of the rod body 41 and releasably engaged with the rod-retaining groove 235 of the respective one of the groove-forming walls 231.

In this embodiment, the locking member 42 is fixed on the end of the rod body 41.

Figure 7:
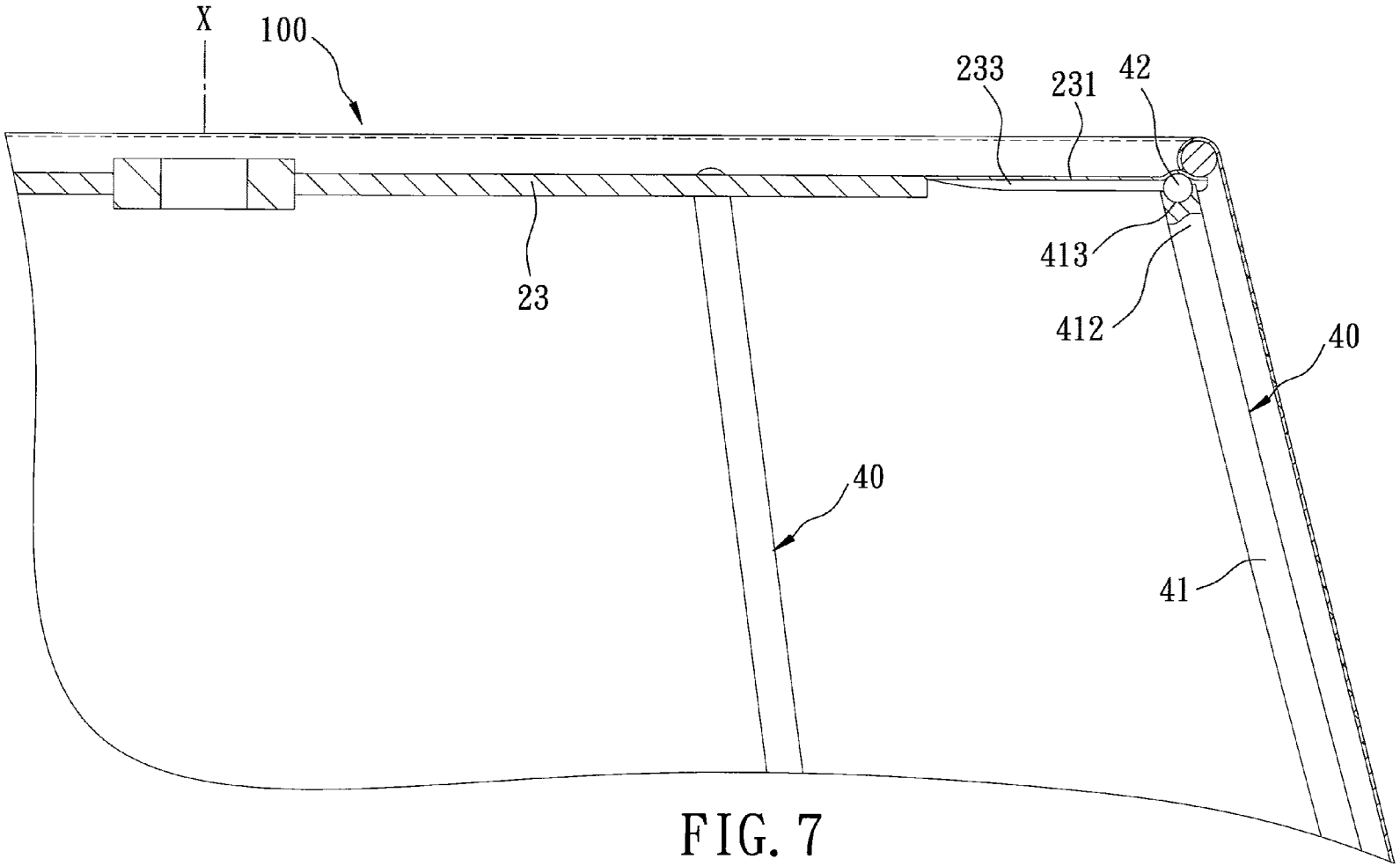
FIG. 7 is an enlarged fragmentary sectional view of the second preferred embodiment of a collapsible lampshade according to this invention.

FIG. 7 illustrates the second preferred embodiment of the lampshade 100 according to the present invention. The second preferred embodiment differs from the previous embodiment in that, for each of the support rods 40, the end of the rod body 41 is formed with a socket 413, and the locking member 42 is mounted rotatably in the socket 413. With this configuration, the locking member 42 of each of the support rods 40 slides easily along the connecting groove 233 of the respective one of the groove-forming walls 231.

In the lampshade 100 of the present invention described above, by forming the connecting grooves 233 in radial directions with respect to the axis (X), the aforesaid drawback associated with the prior art can be eliminated.

With the invention thus explained, it is apparent that various modifications and variations can be made without departing from the spirit of the present invention. It is therefore intended that the invention be limited only as recited in the appended claims.

What is claimed is:

1. A collapsible lampshade comprising:

an upper frame defining an axis, and formed with a plurality of angularly spaced-apart connecting grooves, each of said connecting grooves extending in a radial direction with respect to the axis;

a lower frame surrounding the axis, and spaced apart from said upper frame along a direction of the axis;

a plurality of support rods each having a first end pivotally connected to said lower frame, and a second end opposite to said first end, said second end being received releasably in and being slidable along a respective one of said connecting grooves; and a foldable cover surrounding the axis, and connected to and extending between said upper frame and said lower frame;

wherein said upper frame includes a plurality of groove-forming walls respectively forming said connecting grooves, each of said groove-forming walls being further formed with a rod-retaining groove that is in spatial communication with a respective one of said connecting grooves and that is indented inwardly a greater amount than the respective one of said connecting grooves, said second end of each of said support rods being releasably engaged with said rod-retaining groove of a respective one of said groove-forming walls; and wherein said upper frame includes an annular outer member, an inner member disposed substantially at a center of said outer member, and a plurality of angularly spaced-apart connecting ribs, each of said connecting ribs having a first end connected to said inner member, and a second end opposite to said first end and connected to said outer member, said second end having a respective one of said groove-forming walls.

2. The collapsible lampshade of claim 1, wherein each of said support rods has a rod body, and a ball-shaped locking member disposed on an end of said rod body and releasably engaged with said rod-retaining groove of the respective one of said groove-forming walls.

3. The collapsible lampshade of claim 2, wherein said locking member is fixed on said end of said rod body.

4. The collapsible lampshade of claim 2, wherein said locking member is mounted rotatably on said end of said rod body.

5. The collapsible lampshade of claim 4, wherein said end of said rod body is formed with a socket, and said locking member is mounted rotatably in said socket.

* * * * *